US006928930B1

(12) United States Patent
Göttling et al.

(10) Patent No.: US 6,928,930 B1
(45) Date of Patent: Aug. 16, 2005

(54) DEVICE FOR CLEANING PRINTING CYLINDERS

(75) Inventors: Josef Göttling, Friedberg (DE); Godber Petersen, Augsburg (DE); Rainer Stamme, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 425 days.

(21) Appl. No.: 08/642,866

(22) Filed: May 6, 1996

(30) Foreign Application Priority Data

May 4, 1995 (DE) ..... 295 07 416 U

(51) Int. Cl.[7] ..... B41F 35/00
(52) U.S. Cl. ..... 101/424; 101/425
(58) Field of Search ..... 101/424, 423, 101/425; 15/256.5, 256.51, 256.52; 134/153, 134/148, 151, 152; 399/360, 358, 357, 350, 399/343

(56) References Cited

U.S. PATENT DOCUMENTS

| | | | | | |
|---|---|---|---|---|---|
| 1,196,438 | A | * | 8/1916 | Doyle et al. | 101/425 |
| 2,810,991 | A | * | 10/1957 | Mead et al. | 451/88 |
| 3,102,297 | A | * | 9/1963 | Sands | 15/256.51 |
| 3,486,448 | A | * | 12/1969 | Anderson et al. | 101/425 |
| 3,642,013 | A | * | 2/1972 | Thierstein | 134/113 |
| 3,701,316 | A | * | 10/1972 | Sylvester et al. | 101/425 |
| 3,715,838 | A | * | 2/1973 | Young et al. | 451/87 |
| 3,737,940 | A | | 6/1973 | Moestue et al. | 15/302 |
| 3,835,779 | A | | 9/1974 | Ross et al. | 101/425 |
| 4,054,685 | A | * | 10/1977 | Giori | 101/425 |
| 4,058,059 | A | | 11/1977 | Moestue | 101/425 |
| 4,254,709 | A | * | 3/1981 | Arnolds | 101/425 |
| 4,344,361 | A | | 8/1982 | MacPhee et al. | 101/425 |
| 5,154,121 | A | | 10/1992 | Schneider | 101/401.1 |
| 5,209,164 | A | | 5/1993 | Durrnagel et al. | 101/425 |
| 5,213,040 | A | | 5/1993 | Mihori et al. | 101/424 |
| 6,006,666 | A | | 12/1999 | Göttling | 101/425 |

FOREIGN PATENT DOCUMENTS

| | | | | |
|---|---|---|---|---|
| DE | 4216636 | | 5/1992 | |
| DE | 4218211 | | 12/1992 | |
| EP | 0368177 | | 11/1989 | |
| JP | 0004948 | * | 1/1988 | 101/425 |
| JP | 63-295262 | | 12/1988 | |
| JP | 2-187335 | | 7/1990 | |
| JP | 6-286122 | | 10/1994 | |
| JP | 7-40530 | | 2/1995 | |
| WO | 9412349 | | 6/1994 | |
| WO | 9501876 | | 1/1995 | |
| WO | WO 95/00338 | | 1/1995 | |

* cited by examiner

*Primary Examiner*—Anthony H. Nguyen
(74) *Attorney, Agent, or Firm*—Cohen, Pontani, Lieberman & Pavane

(57) ABSTRACT

A complete cleaning system for printing cylinders within a rotary printing press, by which a reactive erasing of ink-bearing layers, including the removal of filling materials from a gravure printing form, and a cleaning of ink from all form and transfer cylinders are possible during the printing process or during printing pauses. At least one erasing device is provided which emits a jet of water under pressure that can be directed against the corresponding outer surface of each desired cylinder so that, on the one hand, all traces of ink can be removed and, on the other hand, a reactive erasing of ink-conducting layers including filling materials from a gravure printing-form cylinder is possible.

17 Claims, 4 Drawing Sheets

DEVICE FOR CLEANING PRINTING CYLINDERS

BACKGROUND OF THE INVENTION

1. Field of the Invention

The present invention relates to a device for cleaning ink-transfer cylinders within a rotary printing press.

2. Description of the Prior Art

From German application P 42 16 636, to which U.S. Pat. No. 6,006,666 corresponds, a device is already known for the repeated reactive erasing of the ink-bearing layer, i.e. of the organic substance parts, from the surface of an image-bearing printing form on a cylinder. This ink-bearing layer is produced, for instance, by a thermographic, ink-jet, or electrostatic process. For reuse, the material forming the printing locations must be removed or erased so that the surface of the printing form can again bear an image.

The erasing device taught by this reference has at least one nozzle, but preferably several nozzles arranged alongside of each other which can be connected together by a commercial high-pressure cleaning system. The erasing device is arranged in the printing press along the entire printing form width and over a region of the surface of the printing form. Since the printing form is passed rotating below the erasing device, the entire surface of the printing form can be erased. The nozzles of the erasing device are provided with a covering which is open towards the printing form and serves as protection of the environment. The covering defines a working space and is connected to a pump for removing both the water introduced into the working space and the coating which has been removed.

EP 0 368 177 B1, to which U.S. Pat. No. 5,154,121 corresponds, discloses a gravure cylinder in which a solid substance which can be liquefied by the action of energy is introduced into each cell of a raw form in an amount inversely proportional to the amount of ink to be transferred. After a printing has been effected, in order to reestablish the gravure printing form for a further design after the remaining ink has been washed off, an erasing device is applied, which liquefies the filling material in the cells by means of a source of heat and removes it by means of a wiping and/or blowing or sucking device.

SUMMARY OF THE INVENTION

It is an object of the present invention to provide a complete cleaning system for printing cylinders within a rotary printing press by which a reactive erasing of ink-bearing layers is possible, including the removal of filling materials from a gravure printing form and a removal of ink from all form and transfer cylinders during the printing process or during pauses in the printing process.

Pursuant to this object, and others which will become apparent hereafter, one aspect of the present invention resides in a device or system for cleaning printing cylinders within a rotary printing press, which device includes, for each printing cylinder, a separate cleaning apparatus that is operative to emit a pressurized jet of water and is arranged to direct the jet of water against a corresponding outer surface of a cylinder or a sleeve on the cylinder so as to remove all traces of ink and reactively erase ink-bearing layers, including any filling materials, on the cylinder or cylinder sleeve surface. (Hereinafter it will be understood that reference to the outer surface of the cylinder encompasses and applies equally well to the outer surface of a sleeve if one is mounted on the cylinder.)

Due to the fact that for every ink transfer cylinder, i.e. both for the form cylinder or cylinders and for the transfer or rubber-blanket cylinder or cylinders, a separate erasing device is provided, there is developed in the rotary printing press an entire cleaning system by which a reactive erasing of ink-bearing layers, including the removal of filling materials from a gravure printing form and the removal of ink from all form and transfer cylinders, is possible even during the printing process.

For this purpose, the erasing device mentioned previously can be used, and is arranged axially over the width of the cylinder to be cleaned. Water, together with the ink and possibly the filling materials, or organic substance parts, can be drawn out of the cylinder by the erasing device.

Furthermore, in another embodiment of the invention, a doctor blade for scraping-off excess moisture from the surface of the cylinder is arranged behind the erasing device, seen in the direction of rotation of the cylinder to be cleaned. The doctor blade is preferably in the form of a rubber doctor.

For the same purpose, namely in order to remove excess moisture from the surface of the cylinder, a drying device can be used. Such a drying device can be either an air knife or a dry roller.

In principle, any means, including a dry fleece, which eliminates excess moisture from the surface of the cylinder after the cleaning process could be used.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
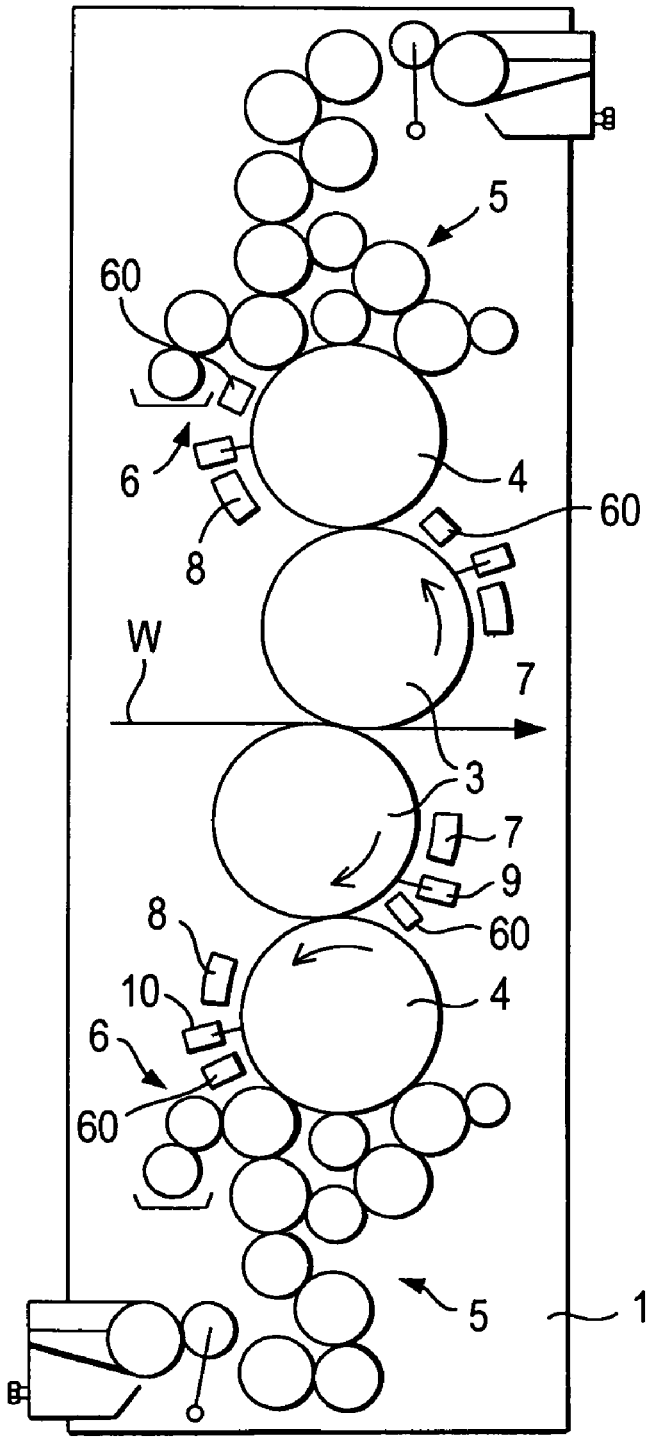
FIG. 1 schematically shows an offset printing press with a cleaning system pursuant to the present invention.

Referring to FIG. 1, a rubber-against-rubber printing unit 1 of an offset printing press comprises, in a known manner, printing-form cylinders 4 and rubber-blanket cylinders 3, as well as two inking units 5 and two damping units 6.

The printing-form cylinder 4 may be a cylinder which is provided with an image in the form of an ink-bearing layer on a hydrophilic surface by means of a thermographic process and which is suitable for offset printing, having an erasing device 8 which can be applied in a known manner, or else a plate cylinder which has been prepared for flat printing.

Similar to the arrangement with respect to the form cylinder 4, erasing devices 7 are also provided for the transfer or rubber-blanket cylinders 3. In the direction of rotation of the cylinders 3, 4 which are to be cleaned, in each case a rubber doctor blade 9, 10 is placed against the surface of the corresponding cylinder down stream of the erasing device. The cylinder 3, 4 can also be cylinders that have sleeves mounted thereon, as is known in the art. Drying means 60, such as an air knife or dry roller, can also be provided to remove excess moisture from the surface of the cylinder. The construction and operation of such drying means are known to those skilled in the relevant art.

Figure 2:
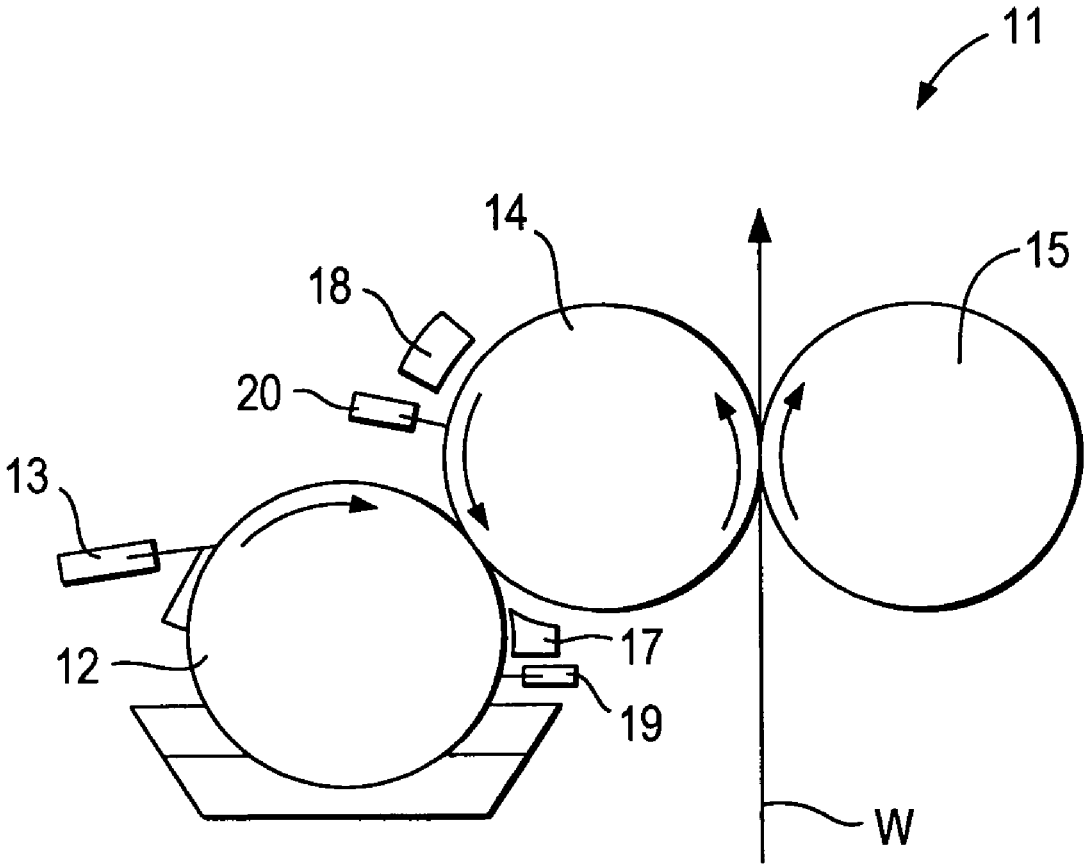
FIG. 2 schematically shows a rotary printing press for indirect gravure with the inventive cleaning system.

FIG. 2 shows the invention arranged in a doctor gravure printing unit 11 for indirect ink-fed rotogravure.

By gravure there is to be understood here a generic term for all printing processes having printing elements which are located below the surface of the form.

In a known manner, the gravure printing unit 11 comprises a gravure printing-form cylinder 12 having a doctor 13 for scraping the ink off all non-printing locations prior to printing, so that the ink remains only in the recessed image locations. The printing unit 11 further includes a rubber-blanket cylinder 14 and an impression cylinder 15 between which a web W passes. Erasing devices 17, 18, each having a rubber doctor blade 19, 20 arranged behind the erasing device 17, 18 as seen in the direction of rotation of the cylinders 12, 14, are associated both with the gravure printing-form cylinder 12 and with the rubber-blanket cylinder 14.

In this way, the erasing of the gravure printing form on the cylinder 12 by washing the ink and the filling material out of the recesses and the cleaning of the transfer cylinder 14 are possible during printing or during a pause in printing.

As filling material, there are preferably used thermoplastic fillers such as thermoplastic. For example, polyolefins, vinyl polymers, polyamides, polyesters, polyacetals, polycarbonates and in part also polyurethanes and ionomers can be used as the filling material.

Figure 3A:
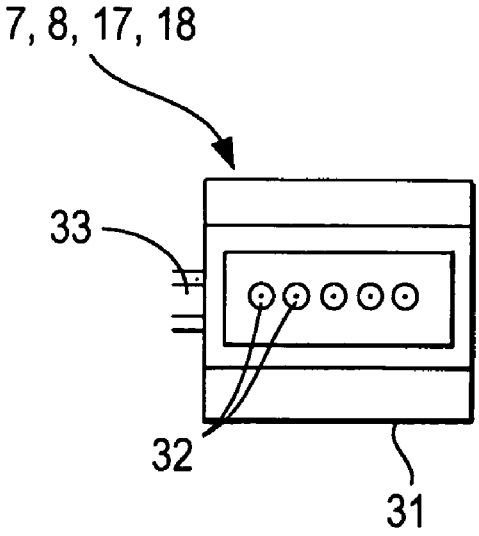
FIGS. 3*a*–3*c* show an erasing device which is connected to a high-pressure cleaning system.
Figure 3B:
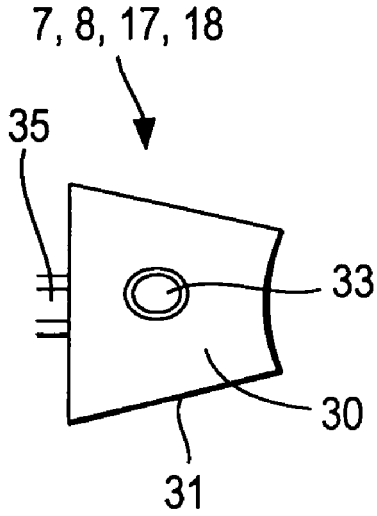
Figure 3C:
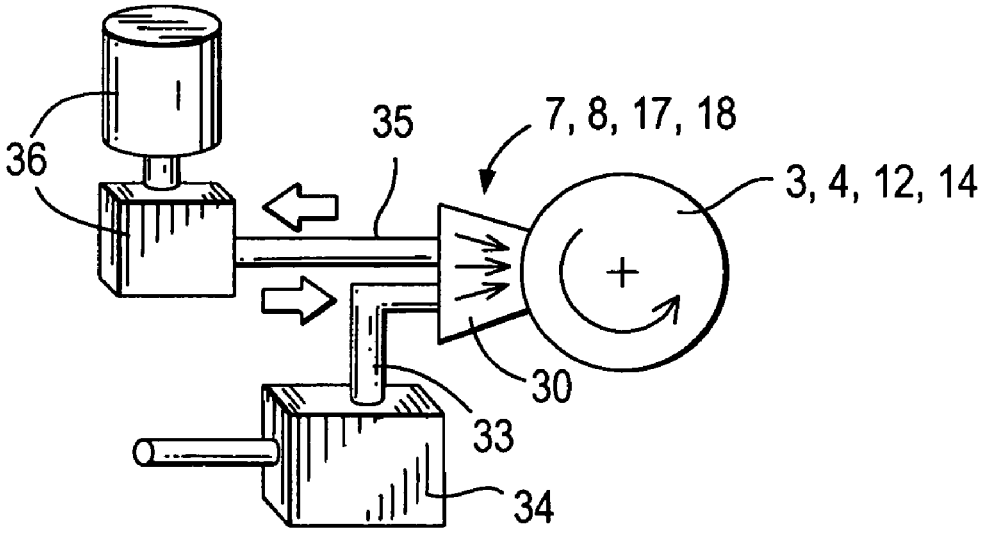

FIGS. 3*a–c* show an erasing device 7, 8 or 17, 18 in detail. Against the cylinder 3, 4, 12, 14 there is placed a high-pressure erasing chamber 30. Within the housing 31 of the erasing chamber 30 are a plurality of high-pressure nozzles 32 arranged in a row parallel to the axis of the cylinder. A water feed 33 extends into the chamber 30 and a water discharge 35 extends out of it. FIG. 3*a* is a front view of the erasing chamber 30, as seen form the cylinder 3, 4. FIG. 3*b* is a side view of the erasing chamber 30. The water feed 33 extends from a commercial high-pressure cleaning system 34 arranged ahead of the erasing chamber, while the water outlet 35 leads to a pump and suction device combination 36 with filter, arranged behind the erasing chamber 30, as shown in FIG. 3*c*.

Figure 4:
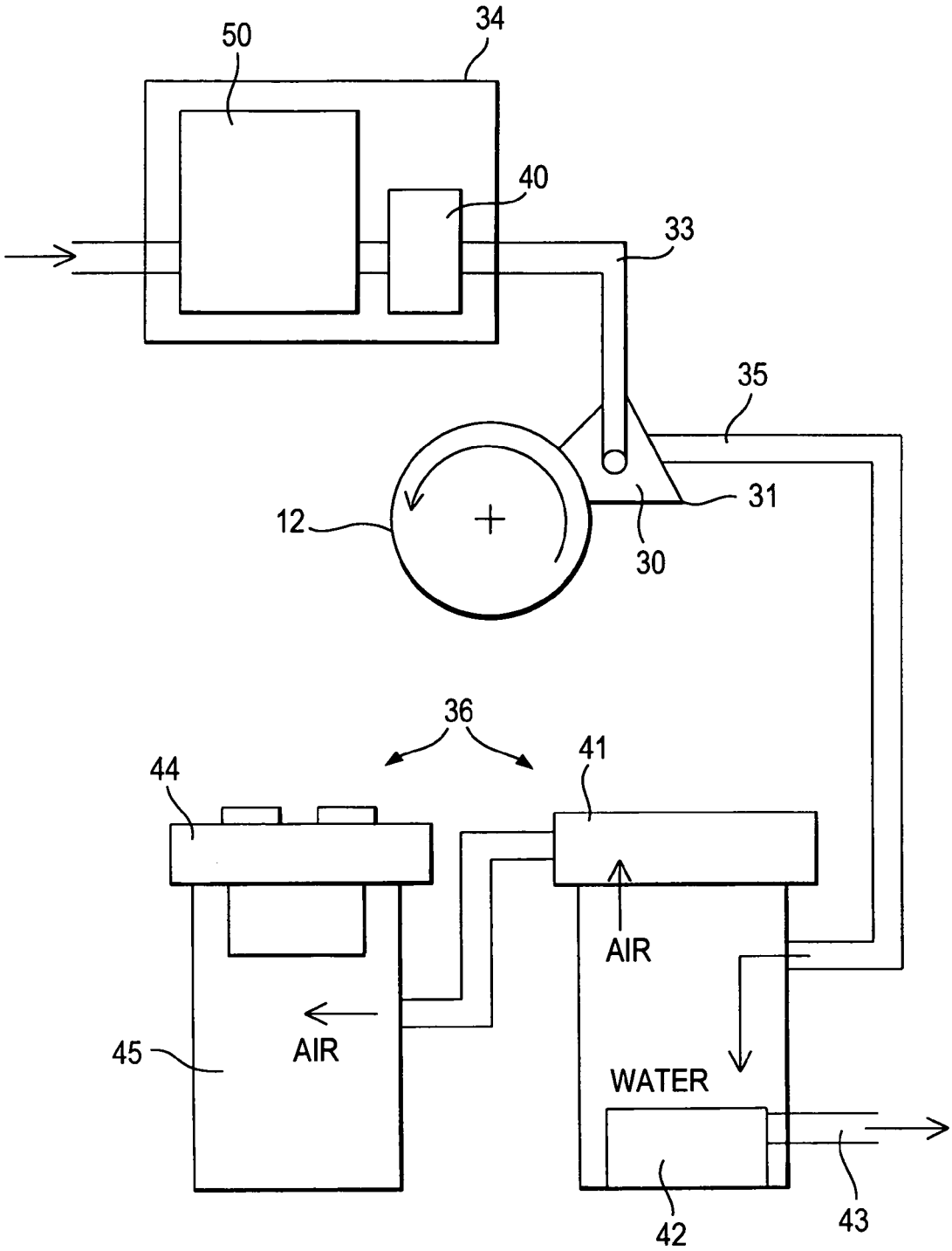
FIG. 4 is a schematic representation of the erasing device of FIG. 3, employed in connection with a gravure-printing-form cylinder.

FIG. 4 shows this erasing device 30 to 36 applied to a photo-engraved roller, and therefore a gravure printing form cylinder 12. The high pressure cleaning system 34 contains a compressor 40 and a heating container 50. The erasing chamber water outlet 35 leads to the pump and suction combination 36 which includes a separator 41 for air and a pump with filter system 42 for the water outlet 43. The air can be drawn off by means of a suction motor 44 of a suction pot 45.

The jet of water is preferably heated to about 85° C. and thus has sufficient energy to also dissolve out the image filling material in the cells of a filled gravure raw printing form. The water in the work space of the erasing device can also be drawn off together with the so-called "gap air".

The invention is not limited by the embodiments described above which are presented as examples only but can be modified in various ways within the scope of protection defined by the appended patent claims.

What is claimed is:

1. A system for cleaning all ink-bearing cylinders mounted within a single rotary printing press, the system consisting essentially of a plurality of erasing devices operative to emit pressurized jets of water, each one of said erasing devices having a plurality of high pressure nozzles arranged in a row parallel to a respective one of the cylinders so as to extend over an entire width of the cylinder, and being configured to direct the jets of water substantially over the entire width of the cylinder against an outer surface of the respective one of the cylinders so as to remove all traces of ink and reactively erase ink-bearing layers via only the jets of water so that the cylinder is simultaneously rendered re-imageable, each said erasing device being arranged over the width of the respective cylinder to be cleaned so that the cylinder is movable rotatably below the erasing device, each said erasing device including a housing which opens towards the outer surface of the cylinder and defines a working space, each said housing being connectable to a pump and suction means for evacuating the working space.

2. A system according to claim 1, and further comprising, for each cylinder, a doctor operatively arranged to scrape excess moisture off the outer surface of the cylinder.

3. A system according to claim 2, wherein the doctor is a rubber doctor.

4. A system according to claim 1, and further comprising, for each cylinder to be cleaned, drying means for removing excess moisture from the outer surface of the cylinder.

5. A system according to claim 4, wherein the drying means includes an air knife.

6. A system according to claim 4, wherein the drying means includes a dry roller.

7. A system according to claim 1, wherein the housings are configured to be arrangeable in an offset printing unit so that all cylinders can be cleaned during printing, said offset unit comprising a printing form cylinder having a hydrophilic surface and an ink transfer cylinder, said printing form cylinder being rendered re-imageable by removing all ink-bearing layers from said hydrophilic surface.

8. A system according to claim 1, wherein the erasing devices are configured to be arrangeable in a gravure printing press and the printing cylinders include a gravure printing form cylinder and ink-transfer cylinders, the erasing devices including a separate cleaning apparatus for each of the cylinders so that both an erasing of a gravure printing form cylinder by washing filling material of recessed locations of a network of cells in the form cylinder can be effected, as well as cleaning of the transfer cylinders.

9. A system according to claim 1, and further comprising means for supplying water to the nozzles.

10. A system for cleaning ink-bearing cylinders in a rotary printing press of the type having printing form cylinders and ink transfer cylinders, said system comprising a row of nozzles arranged parallel to the axis of each printing form cylinder and each ink-transfer cylinder, each nozzle being operative to emit a pressurized jet of water and arranged to direct the jet of water against an outer surface of the respective cylinder, a housing arranged over each row of nozzles, each housing being open toward the outer surface of the respective cylinder and defining a working space, and suction means for evacuating each said housing.

11. A system as in claim 10 wherein said system is adapted for an offset printing unit wherein said printing form cylinders each have a hydrophilic surface, said rows of nozzles arranged parallel to said printing form cylinders being configured to emit jets of water which are effective to remove all traces of ink and all ink-bearing layers from said printing form cylinders.

12. A system as in claim 10 wherein said system is adapted for a gravure printing unit wherein said printing form cylinders have recesses which contain a filling material, said rows of nozzles arranged parallel to said printing form cylinders being configured to emit jets of water which are effective to remove all traces of ink and all filling material from said printing form cylinders.

13. A system for cleaning ink-bearing cylinders in a rotary printing press, said ink-bearing cylinders comprising form cylinders and ink transfer cylinders having respective ink-bearing surfaces, said system comprising rows of nozzles arranged parallel to the axes of respective said ink-bearing cylinders, one said row of nozzles extending along the width of each said form cylinder and one said row of nozzles extending along the width of each said ink transfer cylinder, each said nozzle being operative to emit a pressurized jet of water onto one of said ink-bearing surfaces, said rows of nozzles being arranged so that all ink can be removed from all of said ink-bearing surfaces simultaneously and so that all of said surfaces can be rendered re-imageable simultaneously with removal of ink as said nozzles emit jets of water and said cylinders are rotated, and a housing arranged over each said row of nozzles, each said housing being open toward a respective said ink-bearing surface, each said housing and each respective said cylinder defining a working space which can be evacuated by a pump and suction combination.

14. A system as in claim 13 wherein said system is adapted for an offset printing press wherein said form cylinders each have an ink-bearing surface which is a hydrophilic surface and said transfer cylinders are rubber blanket cylinders.

15. A system as in claim 13 wherein said system is adapted for a gravure printing press wherein said form cylinders are gravure printing form cylinders having recesses which contain a filling material, said rows of nozzles arranged parallel to said printing form cylinders being configured to emit jets of water which are effective to remove all filling material from said recesses simultaneously with removing said ink.

16. A system as in claim 13 further comprising means for supplying water under high pressure to said nozzles.

17. A system as in claim 13 further comprising a pump and suction combination connection to each said housing.

* * * * *